US005487941A

United States Patent [19]

Pepin

[11] Patent Number: 5,487,941

[45] Date of Patent: Jan. 30, 1996

[54] CONTINUOUS/DISCONTINUOUS FILAMENT YARN OR TOW

[76] Inventor: John N. Pepin, R.R. 1, Box 109N, Alfred, Me. 04002

[21] Appl. No.: 243,775

[22] Filed: May 17, 1994

Related U.S. Application Data

[63] Continuation-in-part of Ser. No. 98,210, Jul. 28, 1993, abandoned, which is a continuation-in-part of Ser. No. 791,071, Nov. 12, 1991, abandoned.

[51] Int. Cl.[6] ..... D02G 3/00

[52] U.S. Cl. ..... 428/364; 428/376; 428/377; 57/2; 57/18; 57/203; 57/249; 57/210; 57/905

[58] Field of Search ..... 57/905, 203, 2, 57/244, 249, 18, 210; 428/357, 364, 376, 377

[56] References Cited

U.S. PATENT DOCUMENTS

| | | | |
|---|---|---|---|
| 3,831,369 | 8/1974 | Northup et al. | 57/18 |
| 3,835,637 | 9/1974 | Russell | 57/249 |
| 4,028,874 | 6/1977 | Maag et al. | 57/18 |
| 4,115,992 | 8/1978 | Van Tijn | 57/905 |
| 4,729,215 | 3/1988 | Sato et al. | 57/2 |
| 4,869,059 | 9/1989 | Austin | 57/18 |

*Primary Examiner*—N. Edwards

[57] ABSTRACT

A yarn/tow composed of continuous thermoplastic filaments and discontinuous structural filaments wherein the discontinuous structural filaments are intermingled with the continuous thermoplastic filaments. Groups of discontinuous structural filaments have cut ends which are staggered with those of neighboring groups to allow a continuous structural path along the yarn or tow when the thermoplastic is melted to form the matrix of a composite structure. This hybrid continuous/discontinuous (CD) yarn or tow can be "stretched" as the thermoplastic filaments are melted, allowing the structural filaments to slip relative to one another. Woven forms of this CD precursor can then be molded into complex shapes starting from simple preform shapes.

2 Claims, 6 Drawing Sheets

CONTINUOUS/DISCONTINUOUS FILAMENT YARN OR TOW

This invention was supported by a research grant from the D.O.E. under SBIR Grant No. DE-FG02-90ER80960. The U.S. Government has certain rights in this invention.

This application is a continuation-in-part of application Ser. No. 08/098,210, filed Jul. 28, 1993, now abandoned, which is a continuation-in-part of application Ser. No. 07/791,071, filed Nov. 12, 1991, now abandoned.

This invention resides in the area of designs of constituent material forms that are molded under heat and pressure to form advanced, fiber-reinforced composite structures, and more particularly relates to an improved yarn/tow precursor composition used in the manufacture of such fiber-reinforced composite structures.

Fiber-reinforced composite structures have many forms and process methods involving the pre-process placement of fiber and matrix constituent materials and the molding cycle where the fibers are consolidated or brought closer together and the matrix material is solidified or cured. This type of molding cycle applies heat and pressure to a preformed constituent material shape to form it against a rigid tool, consolidate the fiber reinforcement, and solidify the matrix material. Other composite methods, such as resin transfer molding, impregnate a net shape dry preform to form the composite structure, but it is the former approach of molding a preimpregnated preform to which this invention applies.

Preforms or preshaped fiber and matrix precursor combinations vary from oriented, continuous-filament fabric and tape lay-ups to preimpregnated, randomly oriented chopped-fiber mats. The highest strength, stiffness, and degree of mechanical tailorability is achieved with oriented, continuous-filament preform designs that are processed to achieve fiber volume fractions in the neighborhood of 60%. These preform lay-ups are time-consuming and hence expensive, especially for complex shapes where continuous filaments in the form of woven fabrics or tapes must be carefully placed to conform to contours with multiple curvatures. Many components for aircraft, helicopters, spacecraft and the like that require high strength and stiffness at the lowest weight are fabricated in this manner. Preforms containing randomly oriented, cut or chopped fibers conform more easily to complex shapes, and can even be designed to flow into complex contours, but the random reinforcement orientation limits the achievable mechanical properties. The low fiber volume fraction of this composite form, compared to the continuous filament fabrics or tapes, also limits its properties and hence application to lightly loaded structures. For example, sheet molding compounds (SMCs) used in the automobile industry are molded to form body panels, hoods, trunk lids, cabs and other lightly loaded secondary structures. The advantage of this chopped-fiber sheet molding compound is its high fabrication speed and therefore low cost.

It is an object of this invention to provide a precursor material form that allows forming to a complex shape during molding while still achieving a high fiber volume fraction and closely controlled fiber orientation.

It is a further object of this invention to provide a precursor material form that allows low-cost, rapid fabrication of structures with high specific stiffness and strength.

The invention herein is a novel yarn (twisted) or tow (untwisted) comprised of a mixture of thermoplastic filaments and structural filaments intermingled with each other. While intermixing two types of filaments and the processes to accomplish this are known in the prior art, this invention advances the art by intermixing continuous thermoplastic filaments with discontinuous structural reinforcing filaments. This intermixing allows the yarn or tow to be woven, braided or otherwise constructed to form a fabric lay-up or preform, since the continuous filaments can support a tensile load during the weaving process. Upon molding, the intermixing of continuous thermoplastic filaments with the discontinuous structural reinforcing filaments allows the continuous/discontinuous filament (CD) yarn or tow to stretch along its length as the thermoplastic filaments melt. If properly restrained laterally, such as in a woven form, the reinforcing filaments will remain aligned as they slip over one another so that the original reinforcing direction is preserved. This alignment can also be preserved when molding a non-woven tape form if the molding process, e.g. vacuum bag molding, does not result in a lateral pressure gradient in the molten matrix causing the matrix to flow and the fibers to be "washed" along in these flow directions. The reinforcing filaments in the yarn or tow are placed in segments whose cut ends are overlapped by the discontinuous filaments of a neighboring segment. For example, the reinforcing filament portion of the yarn or tow might consist of two adjacent glass fiber tows cut every two inches (5.00 cm) with the cut surfaces of the filaments placed end-to-end and staggered with the neighboring tow. That is, the cuts in one glass fiber tow would occur in the middle of the adjacent glass fiber segments to provide a maximum length overlap. This arrangement allows slipping of one group over another during molding but maintains load transfer through shear in the molded composite since the fibers are long enough to always have an overlapped region between them.

The invention herein is a molding preform made from a precursor material formed from a yarn or tow having a multiplicity of discontinuous, unentangled structural filaments each oriented in substantially the same direction within the precursor material form as adjacent structural filaments and a multiplicity of thermoplastic filaments oriented in substantially the same manner as the structural filaments within the precursor material form and which are substantially continuous throughout the precursor material form, at least some of the thermoplastic filaments being disposed adjacent to the structural filaments. The precursor material includes means for restraining lateral movement of the structural fibers. Some of the structural filaments are formed into band-like segments, the structural filaments within each segment being oriented in substantially the same direction and the structural filaments within the respective segments being oriented in substantially the same direction. Some of the ends of the segments can overlap within the material form. In some embodiments the structural filaments can be formed into at least two substantially adjacent bands, each band being discontinuous at an angle across the band in at least one location of each band to form segments of said band, the segments having ends defined by discontinuities so formed. In some cases the ends of the segments of the respective bands overlap and wherein the ends of the segments in one of the bands can be disposed substantially medially of the segments in an adjacent band. In some embodiments the thermoplastic filaments can be formed into at least one band, such band of thermoplastic filaments being disposed between the two bands of structural filaments and such thermoplastic filaments being disposed over the exterior surfaces of the bands of structural filaments. The combination of structural filaments and thermoplastic filaments can be woven into a molding preform. The precursor material's structural filaments can be formed of a material selected from the group consisting of glass, carbon, aramid, inviscid melt spun fibers, polybenzbisoxazole, aluminum oxide, silicon carbide and silicon nitride. The precursor materials of the thermoplastic filaments can be formed of a material selected from the group consisting of polyethylene terephthalate, polyphenylene sulfide, polypropylene, polysulfones, polyether ether ketones, polyimides, polyamides, aluminum, thermoplastic fibers and melt processible fibers.

A molded composite structure can be created formed of a yarn or tow made of a multiplicity of discontinuous, unentangled structural filaments each extending in substantially the same direction within the composite structure as adjacent structural filaments and a body of thermoplastic filamentary material which is substantially intermingled with the structural filaments on flowing of said material into substantially continuous contact with said structural filaments over substantially full surfaces of said structural filaments.

Also disclosed is a method of forming a fiber-reinforced composite structure from molding preforms formed of a yarn or tow having the steps of forming a multiplicity of discontinuous, unentangled structural filaments each extending in substantially the same direction within the yarn or tow as adjacent structural filaments; disposing a multiplicity of thermoplastic filaments in adjacent relation to the structural filaments to form the yarn or tow, the thermoplastic filaments having substantially the same orientation within the yarn or tow as adjacent structural filaments, the thermoplastic filaments being substantially continuous throughout the yarn or tow; causing the thermoplastic filaments to flow between the structural filaments to wet the structural filaments; laterally restraining the structural filaments during flow of the thermoplastic filaments, the structural filaments being capable of slipping relative to each other in a direction substantially coincidental with the longitudinal axes of the structural filaments; and solidifying the thermoplastic filaments after flow thereof. The step of causing the thermoplastic filaments to flow can include heating the thermoplastic filaments and/or subjecting them to pressure. The step of laterally restraining the structural filaments includes weaving the yarn or tow into a woven form.

A fabric or other woven form of this CD yarn can be draped into a mold with complex contours but, unlike a fabric woven from continuous filaments, it need not conform exactly to the shape. Its ability to be formed into complex shapes from simple initial starting shapes, e.g. a flat plate, reduces preform cost and increases process speed. Preforms of the prior art with continuous structural filaments must either be net shape to begin with or their fibers must change angles during molding to accommodate complex contours. Preforms fabricated from the CD yarn or tow of this invention can be molded to retain the designed fiber orientation because the extension of the yarn allows formation into deep cavities and contours without changing this designed orientation. Because strengths and stiffnesses of composite laminates, and hence component structural performance, are largely dependent on fiber reinforcement orientation, the CD yarn/tow of this invention offers the opportunity to fabricate low-cost, high-performance composite components.

This invention addresses the need for a precursor material capable of being molded very rapidly and efficiently into complex shapes while preserving high fiber volume fraction and good control over fiber orientation within the molded composite structure.

Figure 2:
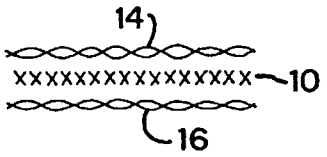
FIG. 2 illustrates an end view of a CD tow showing layered structural and thermoplastic filaments.
Figure 1:
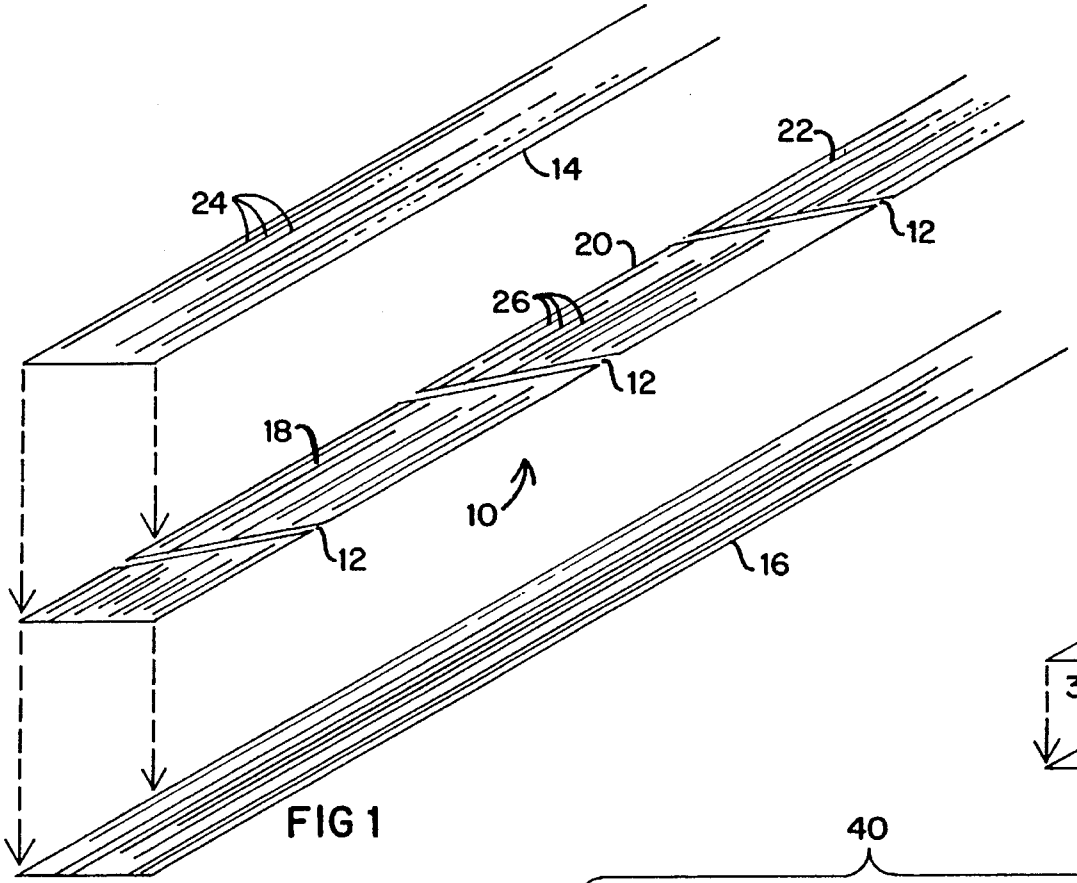
FIG. 1 illustrates a perspective view of CD tow constituents in a flat band form.

FIG. 1 illustrates the initial filament architecture of the CD yarn or tow. Shown in FIGS. 1 and 2 is a band 10 of reinforcing fibers or filaments with cuts 12 to yield a discontinuous banded tow with cut segments 18, 20, 22 adjoining or abutting one another end-to-end. The range of cut directions relative to the longitudinal filament axis can be 90 degrees to give a cut straight across the band to a very low angle, e.g. 5 degrees, to yield a shallow scarf joint or cut across the reinforcing fiber segments. This scarf-type joint or cut would provide enhanced shear load transfer across the cut surface for filaments of the same tow, especially as they would come into closer contact during the molding process. The structural fibers or filaments are banded or spread out into a group or bundle having a width greater than its thickness in order to allow closer contact and intermixing with and among the first and second layers of thermoplastic matrix filament bands 14 and 16, which are also spread out into bands in a similar fashion. The two continuous thermoplastic matrix filament bands 14 and 16 are placed against the discontinuous structural filament segments band 10 on opposing sides to sandwich the discontinuous structural filament segments, such as segments 18, 20 and 22, between them and bring the two types of filaments in the bands into close contact with one another. The degree of uniformity of fiber intermixing required is a function of how well the molten thermoplastic matrix fibers in bands 14 and 16 wet out the structural fibers in discontinuous band 10. For example, if the ability of the matrix filaments to flow and wet the structural fiber in band 10 is very good, then several layers of matrix filaments 24 in matrix band 14 covering several layers of reinforcing filaments 26 in structural fiber band 10 would be an acceptable architecture for the CD tow and lead to a high-guality composite upon processing. Conversely, more uniform intermixing is required for fiber-matrix combinations that are more difficult to consolidate, and consequently the thermoplastic matrix filaments 24 should all be very close to the filaments 26 in reinforcing fiber band 10 that they surround and impregnate when molten. FIG. 2 illustrates this close proximity, with reinforcing fiber band 10 having a thickness of only one layer of filaments 26 being sandwiched by thermoplastic filament bands 14 and 16, which also each have only one layer of thermoplastic filaments 24.

Advanced composite structures designed for high load-bearing stiffness or strength-critical structures have 50%–60% reinforcement fiber volume fraction. This result is achieved in the CD yarn or tow by ensuring that the proper volume ratio exists between the reinforcing fibers and the thermoplastic matrix precursor fibers. Filament cross-sectional area and the number of filaments in each band are chosen to meet the desired volume fraction in the composite. Reinforcement filaments vary in size depending on material, but most would be in the 5–40 micron range with a range of 7–25 microns being very common.

Thermoplastic matrix fibers can be spun with diameters of 15–50 microns or greater to accommodate the selected reinforcement fiber. The reinforcing filament segments are captured between the sandwiching thermoplastic filament bands to allow fabrication of the CD yarn/tow into a woven product form. Capturing, twisting or otherwise binding the discontinuous filaments is necessary to prevent their being stripped off as the CD yarn/tow is handled during the fabrication process. A small amount of binder can be used and either removed before molding or, if compatible, processed along with the woven preform or fabric lay-up. For example, an emulsion of polyethylene terephthalate (PET) can be used to bind PET thermoplastic filaments to discontinuous structural filaments. The emulsion can either be removed or processed into the composite to become part of the matrix. Less than 5% binder by weight is needed, which small amount will also allow the CD fabric or other woven form to be flexible enough to handle and drape into a mold.

The tow illustrated in FIG. 1 can be twisted to form a yarn or folded the reduce its width-to-depth ratio. The width of the band again depends on filament size and number, but a range of 0.1–0.5 inch (0.25–1.25 cm) would cover most applications. After folding or laterally consolidating the band before weaving, the band's width would narrow to the 0.04–0.3 inch (0.1–0.75 cm) range. These ranges are given as examples only and should not be interpreted as excluding applications where larger or smaller filament bundles would be appropriate.

Figure 3:
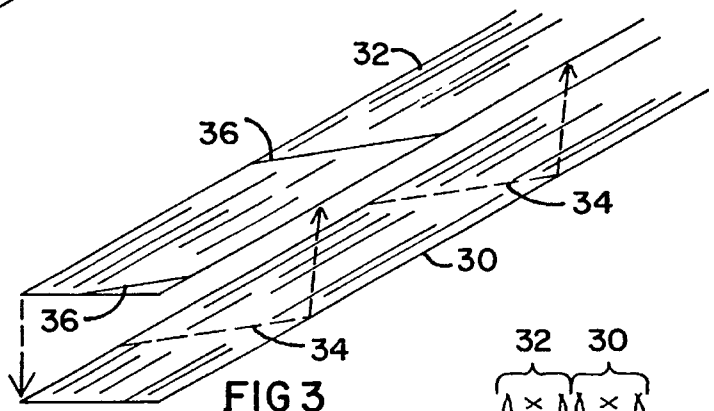
FIG. 3 illustrates a perspective view of two CD tows being placed one over the other with reinforcement filament cut ends staggered.
Figure 4A:
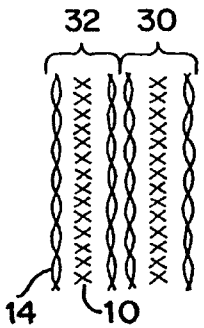
FIG. 4a illustrates an end view of the double CD tow as a flat band.
Figure 4:
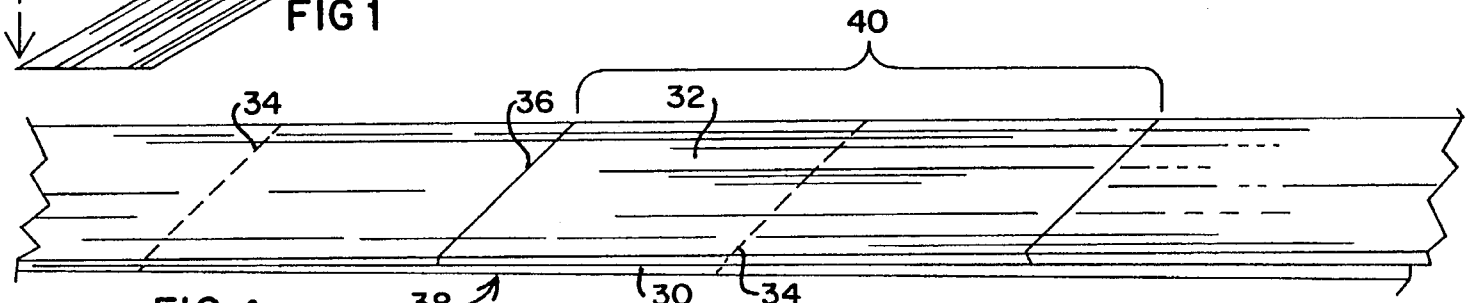
FIG. 4 illustrates a top view of the double CD tow as a flat band.
Figure 5A:
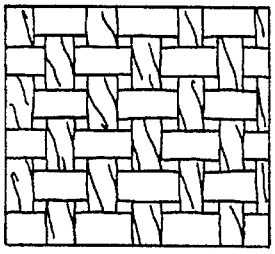
FIG. 5 illustrates various weave architectures which could be fabricate with the CD yarn or tow of this invention.
Figure 5B:
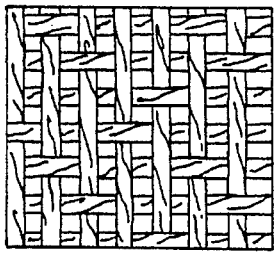
Figure 5C:
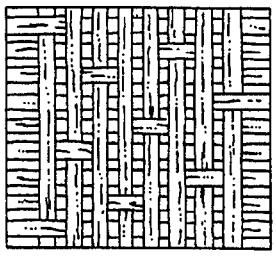
Figure 5D:
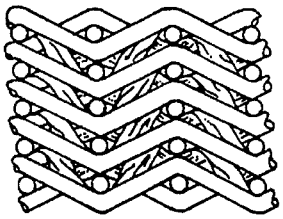
Figure 5E:
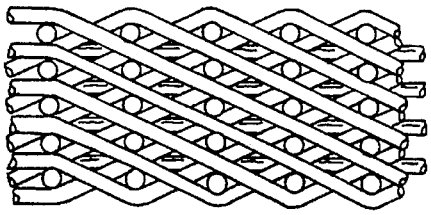
Figure 5F:
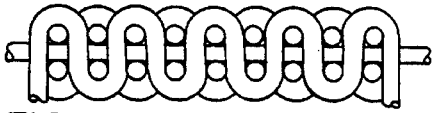

FIG. 3 illustrates two of the CD tows 30 and 32, such as seen in FIG. 1, being placed one on top of the other with the reinforcement filament cut lines 34 of lower tow 30 falling halfway between cut lines 36 of upper tow 32 such that the cuts are staggered in combined tow 38. The double CD tow 38 is also illustrated in FIG. 4 which shows a planar view. FIG. 4*a* illustrates an end view of combined tow 38 of FIG. 4. This staggered CD (SCD) tow form is preferable for preform fabricating and molding since cut regions such as discontinuity 34 in lower tow 30 would always be overlapped by neighboring uncut sections of continuous filaments 40 in upper tow 32 to provide load transfer across discontinuity 34. As the cut filament ends separate during molding due to the extension required to conform to complex shapes, the adjacent overlapping continuous filaments must be long enough to bridge the distance between the separating cut filament ends. Typical lengths of the discontinuous reinforcing filaments would range from 0.5–3 inches (1.27–7.62 cm) with specific lengths designed according to the extension required of various areas of the fabric lay-up or preform. The entire preform could be fabricated with discontinuous reinforcing segments of a single length or could be tailored to have varying lengths to accommodate different extension or physical properties required of various preform locations. The type of reinforcing fiber and/or matrix material might also be varied within the preform to give additional design flexibility.

FIG. 5 illustrates examples of weave architectures that could serve as building blocks for preform fabrication. Two-dimensional fabric weaves such as the plain weave A, crowfoot satin weave B, and eight-harness satin weave C can be placed one on top of the other to form a multiple laminate preform which is then molded to shape. Three-dimensional woven preforms such as the multiwarp D, warp interlock E, and orthogonal F can be used in preforms or areas of preforms where reinforcement is needed through-the-thickness of a planar or shell-type molded shape. For example, the attachment areas of a component can have complex three-dimensional stress states, and it is helpful to have three-dimensional reinforcements in these areas to support such stresses.

Figure 6:
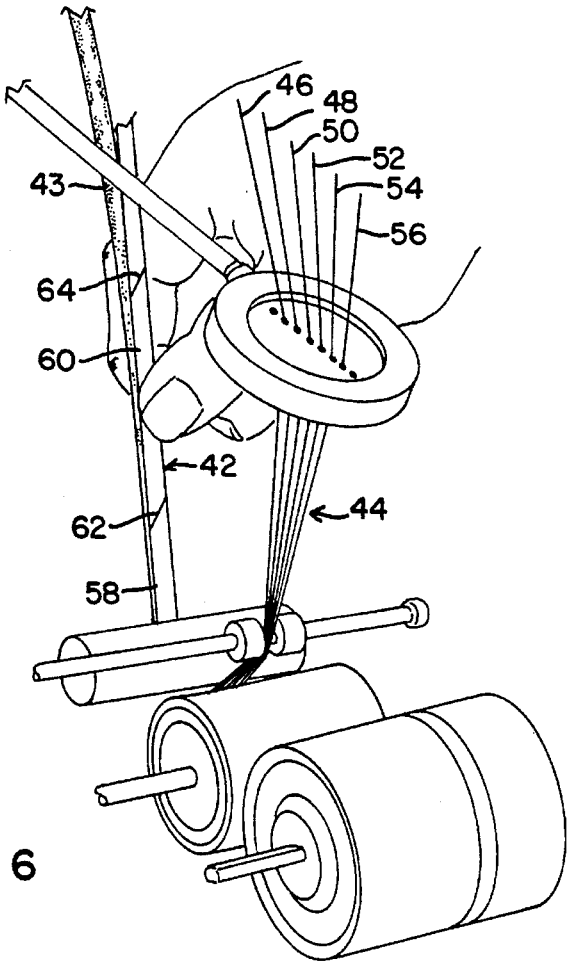
FIG. 6 illustrates the CD tow of FIG. 1 being fabricated.
Figure 7:
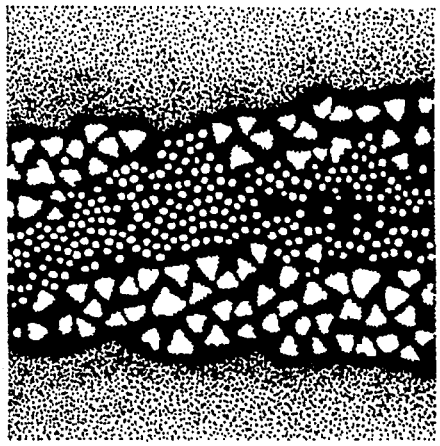
FIG. 7 illustrates a photomicrograph of an end view of the CD tow of FIG. 1.

FIG. 6 illustrates the CD tow of FIG. 1 being fabricated. The structural filaments 42 in this tow are glass in the form of a 1600-filament band whose filaments are 17 microns in diameter. The matrix filaments 43 and 44 are each comprised of six 40-filament PET tows such as tows 46, 48, 50, 52, 54 and 56, which matrix filaments form the upper and lower sandwiching bands. Glass band segments such as 58 and 60 are approximately 2 inches (3.08 cm) long and are cut, such as at points 62 and 64, at 45 degrees to the length axis. Some rollers are not shown to make the sandwiching of the structural filaments by the matrix filaments easier to see, The CD tow thus fabricated is shown in cross section in FIG. 7, which is a 100X photomicrograph of the CD tow showing round glass filaments and triangular PET filaments. Although the intermixing of the two filament types can be improved over the geometry shown, good wet out of the glass filaments by the PET is still achieved with this particular tow.

Figure 8:
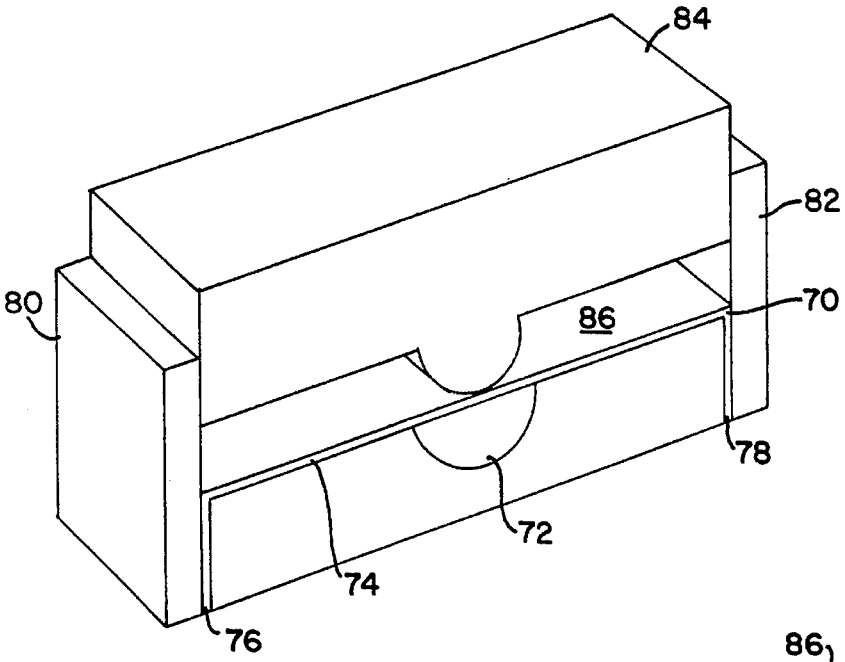
FIG. 8 illustrates several layers of CD tow placed across an open cavity before molding.
Figure 9:
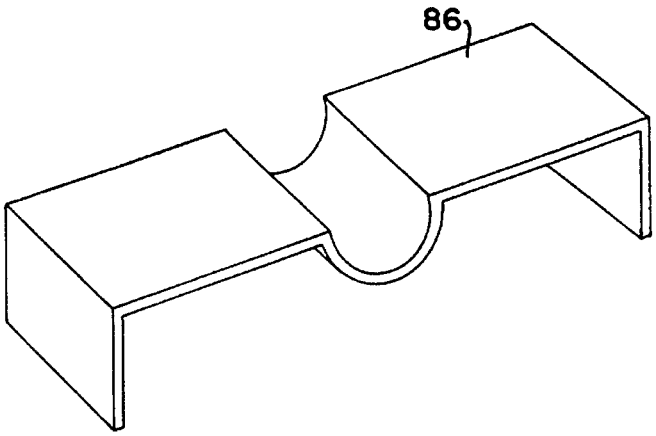
FIG. 9 illustrates the molded component produced from the mold illustrated in FIG. 8 showing the deep forming ability of the CD yarn or tow of this invention.

FIG. 8 illustrates a molding trial using the CD tow such as made by the process shown in FIG. 6. Several layers of CD tow are placed across semicircular cavity 72 such that the multiple, unidirectional CD band 70 bridges at point 74 cavity 72. The ends 76 and 78 of the band are clamped by elements 80 and 82. This band is shown supporting the weight of upper half 84 of the mold. As CD band 70 is heated and the PET filaments melt, the discontinuous glass segments are free to slide along each other to allow the band to "stretch" and be formed into cavity 72. FIG. 9 illustrates the finished molded specimen 86.

Figure 10:
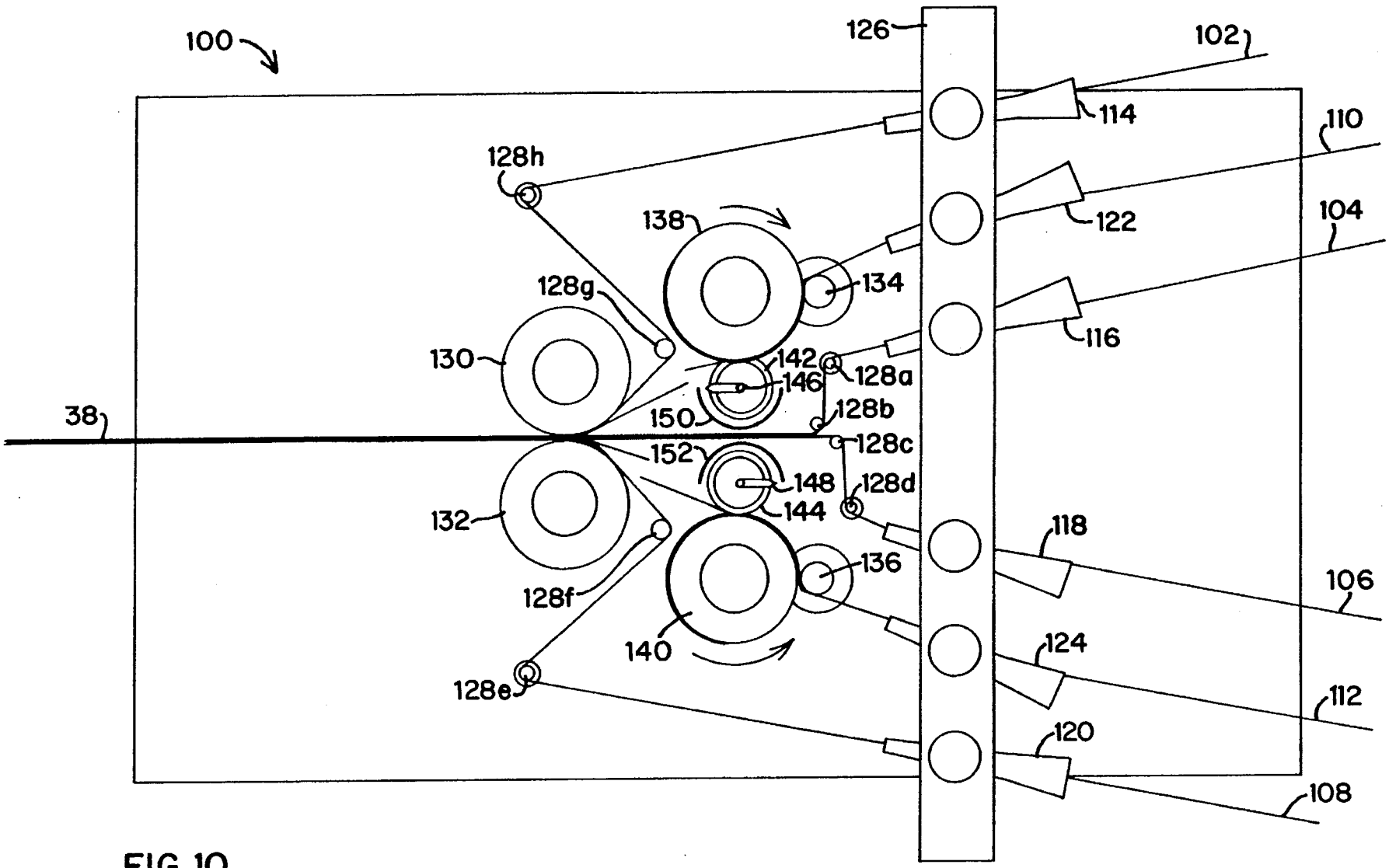
FIG. 10 illustrates the CD tow of FIGS. 3, 4 and 4A being fabricated.

FIG. 10 illustrates the double CD tow 38 of FIGS. 3, 4, and 4A being fabricated on a fabrication apparatus 100. The upper and lower bands of each of the two sandwich assemblies in the double CD tow 38 are formed from four continuous 510 denier, 240-filament PET tows 102, 104, 106, 108, drawn from, e.g., separate spools (not shown). The structural filaments of the double CD tow 38 are formed from two continuous 1800 yd/lb (370 m/N), 1600-filament E-glass tows 110, 112, also drawn from, e.g., separate spools (not shown). The filaments of E-glass tows 110, 112 are 17 microns in diameter. In view of these materials, a composite formed using double CD tow 38 would have an E-glass fiber volume fraction of about 54%.

Each tow 102, 104, 106, 108, 110, 112 passes through a respective flared glass or ceramic guide tube 114, 116, 118, 120, 122, 124 pivotally mounted to a restraining bar 126. After exiting guide tubes 114,116, 118, 120, PET tows 102, 104, 106, 108 are turned and spread into bands by stationary guide pins 128*a–h*. The spread PET tows are then routed to a pair of motor-driven rubber nip rollers 130, 132, which draw the tows though apparatus 100.

After exiting guide tubes 122, 124, E-glass tows 110, 112 are spread into bands as they pass between a respective steel idler rod 134, 136 and an associated motor-driven rubber backing roller 138, 140. Steel idler rods 134, 136 contact rubber backing rollers 138, 140 with sufficient force to ensure that E-glass tows 110, 112 are drawn into apparatus 100 at a fairly constant rate. After being drawn past steel idler rods 134, 136, the spread E-glass tows travel along the outer circumference of rubber backing rollers 138, 140 toward motor-driven rotating cutters 142, 144. Once every revolution, a blade 146, 148 on each rotating cutter 142, 144 rotates into contact with the associated rubber backing roller 138, 140, cutting the spread E-glass tows traveling thereon. The rotation of rotating cutters 142, 144 is synchronized to the rotation of both rubber backing rollers 138, 140 and nip rollers 130, 132. For a double CD tow 38 manufactured on apparatus 100, the distance between cut lines 34, 36 in FIGS. 3, 4, and 4A is thus determined by both the circumference of rotating cutters 142, 144, and the number and relative position of blades 146, 148 on each cutter. Shields 150, 152 ensure that blades 146, 148 do not cut PET tows 104, 106, which pass between rotating cutters 142, 144.

After being cut by blades 146, 148, the cut E-glass tows are driven toward nip rollers 130, 132 by the frictional force between rubber backing rollers 138, 140 and steel idler pins 134, 136. The out, free ends of the E-glass tows are guided between the nip rollers by spread PET tows 102, 104, 106, 108. For example, as shown in FIG. 10, the cut end of E-glass tow 112 advances toward spread PET tow 108. When the cut end contacts the spread PET tow, it is drawn along with PET tow 108, in conveyor-belt fashion, to nip rollers 130, 132. Once the cut end passes between nip rollers 130, 132, the nip rollers then draw the spread E-glass tow 112, directly from rubber backing roller 140. Because of this arrangement, the distance between the nip roller interface and the rubber backing roller/rotating cutter interface should be approximately equal to or less than the distance between successive cuts in E-glass fibers 110, 112.

As shown in FIG. 10, blades 146, 148 of rotating cutters 142, 144 are 180° out-of-phase with respect to one another. Because rotating cutters 142, 144 and rubber backing rollers 138, 140 have the same rotational speeds and circumferences, in double CD tow 38 the successive cuts in E-glass tow 110 lie midway between the successive cuts in E-glass tow 112. This is reflected by the relative orientations of cuts 34, 36 in FIG. 4. Thus, the relative spacing and/or frequency of the cuts in E-glass tows 110, 112 can be varied by changing the rotational phase offset of blade 146 with respect to blade 148 or by changing the relative circumferences and rotational speeds of cutters 142, 144 and rollers 138, 140, or by changing the number of cutting blades 146, 148.

In addition, blades 148, 150 are parallel to the axes of rotation of rotating cutters 142, 144. The cuts in E-glass tows 110, 112 are therefore at 90° to the longitudinal axes of the spread E-glass tows. To scarf-cut the tows at some angle other than 90°, blades 148, 150 would be made suitably helical.

Although fabrication apparatus 100 has been described in connection with the manufacture of double CD tow 38 having six separate tow bands, it can be used for other tow architectures as well. For instance, PET tow 106 can be removed entirely to produce a five band PET-glass-PET-glass-PET tow. For a tow having this five-band architecture to yield a composite having an E-glass fiber volume fraction of 54%, 680 denier PET tows would be substituted for the 510 denier PET tows described above. Any of the other constituent tows can similarly be removed or replaced to yield a CD tow with the desired characteristics. Nor must the E-glass tow always be sandwiched between two PET tows. For instance, all but PET tow 108 and E-glass tow 112 could be removed from apparatus 100. Furthermore, the principles reflected in the construction of apparatus 100 could be employed to manufacture a device for producing CD tows comprised of any desired combination or number of continuous and discontinuous filament tows.

As discussed above, it is necessary to bind the discontinuous filaments in order to prevent them from being stripped off as the CD tow is handled during the fabrication process. As also stated above, the binder can be a chemical, such as an emulsion of polyethylene terephthalate (PET). Alternatively, the binder can be comprised of at least some of the continuous filaments themselves. For example, the discontinuous filaments can be captured between either two untwisted bands of continuous filaments, in a sandwiching arrangement. The sandwich can then be left as is, or twisted or false-twisted into a yarn with the continuous and discontinuous filaments remaining substantially parallel to the longitudinal axis of the tow. Similarly, a CD tow having a single band of continuous filaments and a single band of discontinuous filaments can be folded, twisted, and/or false-twisted to bind the discontinuous filaments. In general, the type of binder employed depends on the conditions under which the CD tow will be processed: The more aggressively the CD tow will be handled, the more robust the binder should be in order to prevent substantial quantities of the discontinuous fibers from being stripped out.

Figure 11:
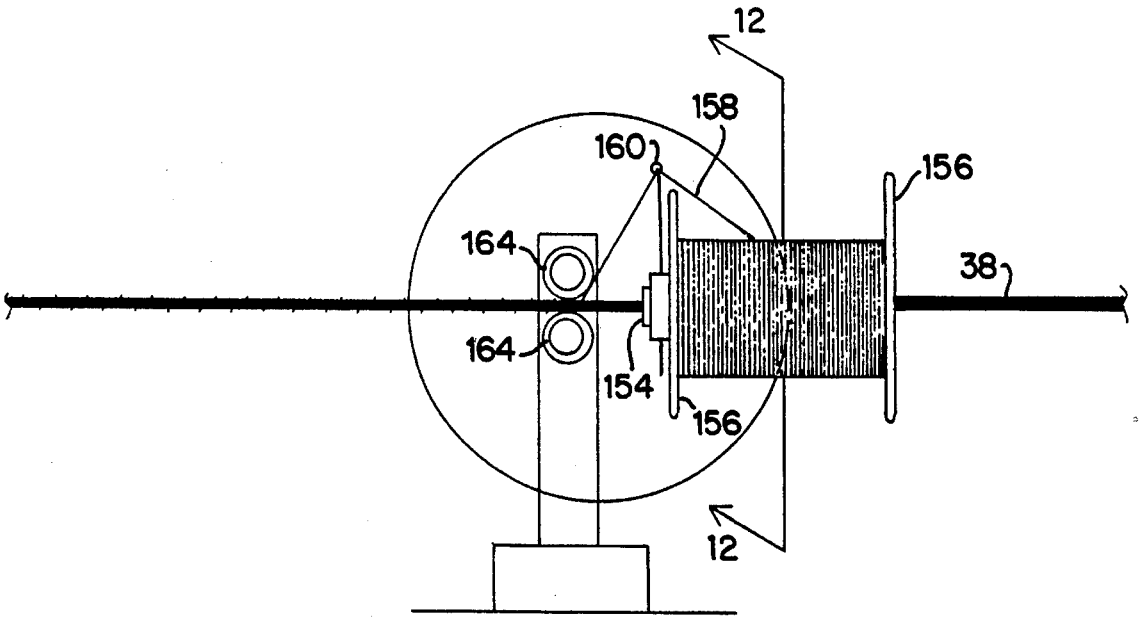
FIG. 11 illustrates the fabrication of a CD tow according to the invention.
Figure 12:
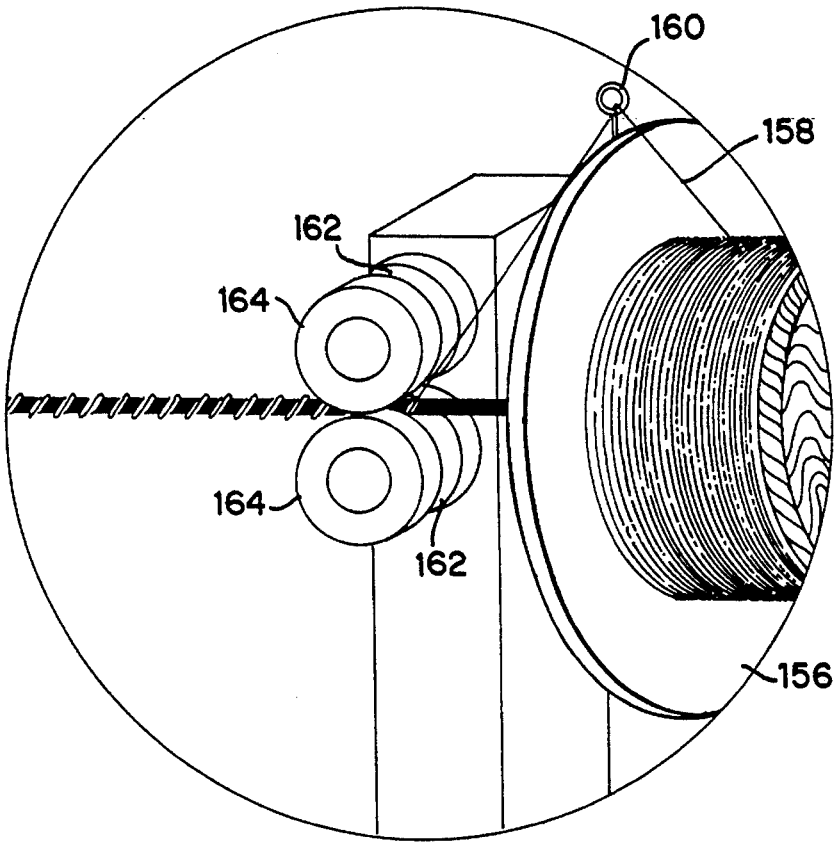
FIG. 12 is a detail sectional view taken along line 12—12 in FIG. 11.

Another suitable binder is a helical fiber wrap around the outside of the continuous and discontinuous tow assembly. One technique for applying such a helical wrap, termed "serving," is depicted in FIGS. 11 and 12. A continuous and discontinuous tow assembly, for example double CD tow 38 described above in connection with FIGS. 3, 4, 4A, and 10, passes through the hollow core of a motorized spindle 154, on which is mounted a spool 156 of thread 158. Because thread 158 becomes a part of the CD tow and is processed with the continuous and discontinuous fibers to form the composite structure, it is composed of a material that is compatible with the continuous and discontinuous fiber materials in the final structural composite. For example, if the continuous fibers are PET and the discontinuous fibers are E-glass, thread 156 can be, e.g., PET or polyester.

As spool 156 rotates, thread 158, guided by eyelet 160 and V-shaped grooves 162 of rollers 164, winds in a helical fashion about moving tow 38. The rotation of spindle 154 is synchronized with the linear speed of tow 38 through the core to give the desired number of wraps per unit length. Typically, the number of wraps per unit length is selected in accordance with the average length of the discontinuous fibers. For instance, where the discontinuous fibers are each on the order of 2.0 inches (5.0 cm), 12–16 wraps per inch (5–6 wraps per cm) has been found to be acceptable.

The constituent materials for CD and SCD tows/yarns can be chosen from a wide variety of structural fibers and thermoplastic matrices. Fiber and matrix combinations can also be mixed to achieve desired mechanical, thermal, chemical or other physical properties. Suitable structural fibers would include, but not be limited to, E-glass, S-glass, aramid, carbon, inviscid melt spun (IMS) fibers (a ceramic fiber, developed by University of Wisconsin researchers, which is produced using a redrawn, melt-spinning process), polybenzbisoxazole (PBO), aluminum oxide, silicon carbide and silicon nitride. Similarly, thermoplastic or other melt processible fibers which would be suitable as matrix fibers would include, but not be limited to, polyethylene terephthalate (PET), polyphenylene sulfide (PPS), polypropylene (PP), polysulfones, polyether ether ketones (PEEK), polyimides, and polyamides (nylon). Metals such as aluminum can also be included as precursor constituents for metal matrix composites.

In general, the structural and matrix fibers are chosen in accordance with the application in which the composite will be used. Two considerations are typically kept in mind when selecting the materials of the constituent fibers. First, the melting point of the matrix fiber is generally below the melting point of the structural fiber. For example, the melting points of polyethylene terephthalate (PET), polyphenylene sulfide (PPS), polypropylene (PP), polysulfones, polyether ether ketones (PEEK), and polyamides (nylon) are 265° C., 285° C., 175° C., 400° C., 343° C., and 100° C., respectively. Second, the structural fiber material often has a greater tensile strength than the matrix fiber material. For example, the tensile strengths of E-glass, S-glass, aramid, carbon, inviscid melt spun fibers, alumina, silicon carbide, and polybenzbisoxazole (PBO) are 3445 MPa, 4585 MPa, 3600–4100 MPa, 3300–6800 MPa, 1380 MPa, 1900 MPa, 2500–3200 MPa, and 4830 MPa, respectively. However, there are applications in which other properties of the structural and matrix fibers, such as their thermal transfer and electrical conductivity characteristics, control the selection.

The goal of the current invention is to provide a high performance, rapidly molded, composite component. This means that the fiber volume fraction is at least 40%, but preferably 55%–60%, and the fibers are oriented in directions appropriate to the mechanical loading, thermal environment, or other necessary boundary conditions. A CD tow of this invention that has been tested and found to work well has about 57% by volume structural fiber, being E-glass, and about 43% by volume thermoplastic fiber, being polyethyleneterephthalate from recycled soft drink bottles. Typical staple-to-continuous filament throughput ratios of prior art patents are 0.031 and 0.008. These ratios are far lower than those that would be generally be used for the structural composite precursor of this invention. However, a difference between the staple form prior art yarns or tows and the CD tow of the present invention is even more basic. One key characteristic of the CD tow of the current invention, and that which makes it quite unique and different from staple prior art yarns, is that the discontinuous structural filaments are not entangled. This feature allows them to slip relative to one another with very little frictional force and virtually no damage to the structural fibers. A staple yarn construction of the prior art, on the other hand, deliberately entangles the discontinuous filaments to improve tensile strength, provide greater bulk, or yield a fuzzy or decorative surface. These goals are fine for making yarns that are woven into upholstery fabrics, drapes, or carpets, but are generally not desirable characteristics of a rapidly formable precursor for a high-quality structural composite which the present invention teaches.

If an attempt were made to use any form of staple yarn in the application described for the present invention, the forces required to pull the entangled structural filaments would be very high, and in fact would break these filaments as the stretching was attempted, negating any overlap between structural filaments and hence load transfer across them. The CD tow of this invention is designed specifically to allow long lengths (typically 0.5 to 3 inches and longer) of structural fibers to easily slip relative to each other without damage, thereby allowing a fiber preform fabricated with this tow to change shape during the molding process. Structural filaments in the tow maintain a high degree of fiber-to-fiber contact and hence yield a composite component with high stiffness and strength. Fiber alignment in the direction of the elongation is also preserved. The cut structural filaments of the CD tow are carefully placed so they bridge the cut areas of adjacent filament groups. There is always a load-transfer mechanism through shear from one segment of filaments to its adjacent segment. Tensile tests and fabric stretching experiments have been performed to develop and test the present invention.

To compare the forces required to "stretch" a staple yarn and the CD tow of the present invention, each form was tested in tension, and load-versus-deflection was plotted. The yarn or CD tow was wrapped around pins held by clevises mounted in each grip of a test machine. The wrap produced 10 lengths of yarn or tow extending between the pins, 5 on each side of the pins. The pins were initially 6 inches (15.24 cm) apart. The test machine pulled this wrapped configuration until the first of either failure or 0.5 inches (1.27 cm) of extension.

The staple yarn used was a 1300 denier E-glass yarn with powdered polyphenylene sulfide resin sprinkled onto the filaments. This yarn was manufactured by Heltra, Inc. A similar product is available from Schappe of France. The mass per unit length of this yarn, plus resin, was 0.164 gm/m. The CD tow was composed of two 0.294 gm/m E-glass tows from Owens Corning, and three 0.075 gm/m polyethyleneterephthalate (PET) tows spun from recycled soft drink bottles by Hills R & D of Melbourne, Fla. Each glass tow was cut into 1.3 inch (3.3 cm) segments laid end-to-end. The cuts of one glass tow were staggered with those of the other so that the cuts of one fell in the middle of the cuts of the other. The stacking sequence within the tow was PET/glass/PET/glass/PET. the tow was overwrapped or served with a very light 40 denier PET yarn. The mass per unit length of this CD tow was 0.813 gm/m. The amount of glass fiber in the CD tow was 3.5 times the amount of glass fiber in the staple yarn. The CD tow was 57% by volume glass and 43% by volume PET.

Figure 13:
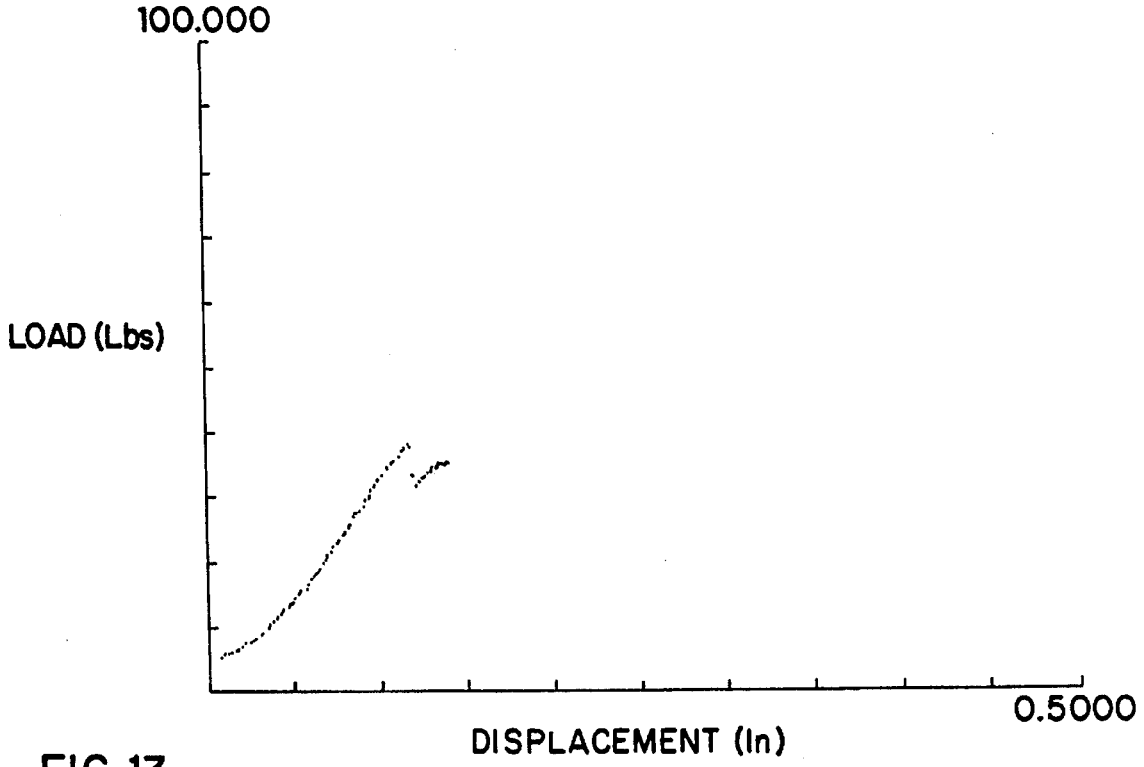
FIG. 13 illustrates test results for prior art staple yarn.
Figure 14:
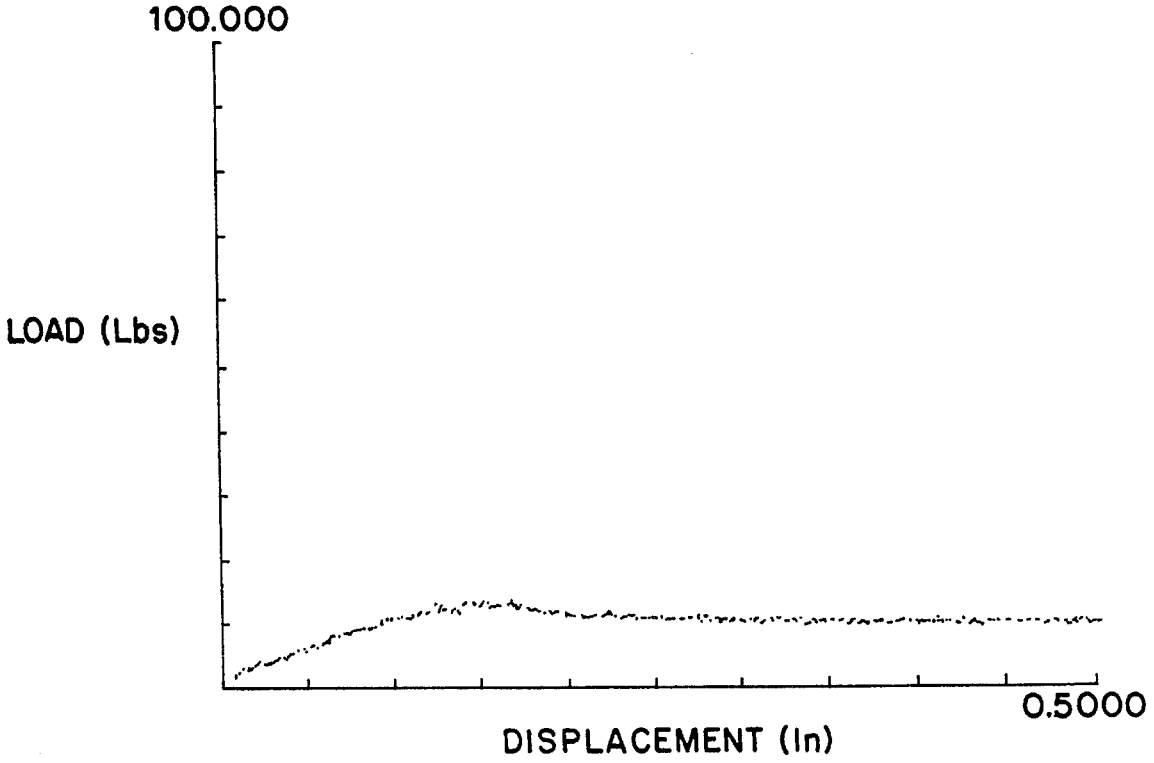
FIG. 14 illustrates test results for the CD tow of this invention.

The results of the tensile tests are given in FIG. 13 for the staple yarns and FIG. 14 for the CD tow. The staple yarns reached a load of close to 40 lbs at an extension of 0.14 inch, and then failed abruptly because the entangled glass filaments were carrying this tensile load and they reached their failure load. The yarn separated at the failure point. The CD tow of this invention, on the other hand, continually stretched at a load level of 10 lb up to 0.5 inch, at which point the test was stopped.

Stretching could have continued further. Since the glass filaments of the CD tow are not entangled, they simply slide over each other as the PET filaments stretch, causing no damage to the glass filaments. In an actual molding operation, the PET filaments would be molten and the only resistance to glass-over-glass filament sliding would be the shear flow resistance of the molten resin. A key difference here is that the entangled architecture of the prior art staple form causes the structural filaments to support tensile load as the yarn is stretched, causing failure of the structural fibers. In contrast, the layered, unentangled architecture of the CD tow allows continual stretching, with no damage to the structural fibers. When woven into a preform the CD tow's ability to stretch will allow the preform to change shape during molding without damaging structural fibers. This ability will greatly facilitate molding complex composite material components with high fiber volume fraction and controlled fiber orientation. This result simply cannot be achieved with a prior art staple yarn or any similar form where the structural filaments are entangled.

A stretching test with a 9-ply fabric laminate was also performed. A four harness satin balanced weave fabric was woven with a glass/PET CD tow. A 2 inch (5.08 cm) band in the middle of the rectangular stack of fabric was heated to melt the PET filaments, allowing easy stretching of the fabric layup by pulling the ends. The fabric was stretched 0.25 inches (0.64 cm) within the molten band. A tensile test of an unstretched CD tow glass/PET balanced fabric laminate with 57% fiber volume showed a strength of 50 ksi (345 MPa) and a modulus of 3 msi (20.7 GPa). These values are very high for a discontinuous form, especially one with the formability of the CD tow based preform of this invention.

Additional testing was performed on similar molded fabric panels. Seven plies of 5 harness satin fabric were stacked with all the warp and fill fibers aligned from one ply to the other to form a 0°, 90° cross-ply layup. One such fabric layup was molded into a composite panel without stretching. Two other panels were stretched in the warp direction as previously described by selectively melting a 2 in. (5.08 cm) wide band in the middle of the panel and pulling the edges of the panel. The panels were then molded to form two additional composite plaques. One of these was further treated to crystallize the PET matrix, while in the other, the matrix was left in the as-molded amorphous condition. Tensile, compressive and shear specimens were cut from these panels and tested in the direction of stretching; for example, a 21 cm long tensile specimen had a 5.08 cm long zone at its mid-length where it was stretched in the same direction that it will be pulled to failure.

As reflected in Table 1, below, data for the amorphous matrix were generally higher than for the crystalline matrix, and higher strengths were found at lower temperatures. The stretched and unstretched data are similar with the exception of the tensile data, which is lower for the unstretched panel. This could be the result of molding pressure or other slight differences in panel fabrication. The data show that there is no dramatic loss of material properties upon stretching.

TABLE 1

Mechanical Test Data for Stretched and Unstretched Panels

| | Strength MPA | Modulus GPA | Poisson's Ratio | Failure Strain % |
|---|---|---|---|---|
| Tensile | | | | |
| crystalline @ 18.3° C. | 301.6 | 18.32 | .074 | 1.098 |
| crystalline @ 18.3° C.* | 245.0* | 17.10* | | |
| crystalline @ −40° C. | 329.8 | 16.93 | .005 | 1.917 |
| crystalline @ 57° C. | 287.9 | 15.97 | .11 | 1.087 |
| amorphous @ 18.3° C. | 323.8 | 22.23 | .127 | 1.170 |
| amorphous @ −40° C. | 384.0 | 22.38 | .162 | 2.181 |
| amorphous @ 57° C. | 291.8 | 18.66 | .162 | 2.007 |
| Compression | | | | |
| crystalline @ 18.3° C. | 281.3 | 28.71 | .152 | 0.960 |
| crystalline @ 18.3° C.* | 279.0* | 23.8* | | |
| crystalline @ −40° C. | 295.4 | 22.80 | .197 | 0.937 |
| crystalline @ 57° C. | 232.7 | 16.18 | .185 | 1.109 |
| amorphous @ 18.3° C. | 310.2 | 26.46 | .168 | 1.022 |
| amorphous @ −40° C. | 366.7 | 27.67 | .115 | 1.221 |
| amorphous @ 57° C. | 208.8 | 29.50 | .182 | 0.707 |
| Shear | | | | |
| crystalline @ 18.3° C. | 81.47 | 3.83 | | |
| crystalline @ 18.3° C.* | 86.3* | 3.22* | | |
| crystalline @ −40° C. | 117.2 | 3.65 | | |
| crystalline @ 90° C. | 59.41 | 1.35 | | |
| amorphous @ 18.3° C. | 82.09 | 3.02 | | |
| amorphous @ −40° C. | 114.9 | 3.42 | | |
| amorphous @ 90° C. | 9.58 | .211 | | |

Note:
*denotes the average of three tests performed on specimens cut from an unstretched panel; all other data are single data points from stretched panels.

Further testing was performed on similar molded fabric panels. Seven plies of 5 harness satin fabric were stacked with all the warp and fill fibers aligned from one ply to the other to form a 0°, 90° cross-ply layup. One fabric layup was molded into a composite panel without stretching. One fabric layup was stretched in the warp direction as previously described, by selectively melting a 2-inch (5.08 cm) wide band in the middle of the panel and pulling the edges of the panel by 0.25 inches (0.64 cm). A third fabric layup was constructed using continuous E-glass fibers. For all panels, the PET was left in the as-molded amorphous condition, and tensile tests were done at room temperature in the direction corresponding to the fill direction of the fabric layup. Test results are shown in Table 2, below:

TABLE 2

Mechanical Test Data for Stretched and Unstretched Panels

| | Tensile Strenth (MPa) | Tensile Modulus (GPa) |
|---|---|---|
| Continuous E-Glass | 483.1 | 21.0 |
| | 500.0 | 20.3 |
| | 496.3 | 21.8 |
| Discontinuous | 310.6 | 18.3 |
| E-Glass, Unstretched | 297.8 | 23.5 |
| | 241.4 | 24.9 |
| Discontinuous | 235.4 | 14.9 |
| E-Glass, Stretched | 287.1 | 22.9 |
| | 282.5 | 16.8 |

The goal of this invention is to provide a yarn/tow to create a molding preform to develop rapidly processible, high-performance composite structures for the frames and other primary structures of cars and trucks. The reformability and recyclability of these structures are also very attractive features to auto manufacturers.

Although the present invention has been described with reference to particular embodiments, it will be apparent to those skilled in the art that variations and modifications can be substituted therefor without departing from the principles and spirit of the invention.

I claim:

1. A yarn or tow useful in forming molding preforms comprising a single layer of a multiplicity of discontinuous, unentangled filaments 10 in an amount of 40–60% by volume which is sandwiched between a first and second layer of continuous filament bands 14 and 16;

a helical fiber wrap binds said discontinuous filaments 10 together with said first and second continuous filament bands 14 and 16, wherein said helical fiber wrap and said continuous filament bands are formed of a material selected from the group consisting of polyethylene terephthalate, polyphenylene sulfide, polypropylene, polysulfones, polyether ether ketones, polyimides, polyamides, and aluminum.

2. The yarn or tow of claim 1 wherein said discontinuous filaments 10 are formed of a material selected from the group consisting of glass, carbon, aramid, inviscid melt spun fibers, polybenzbisoxazole, aluminum oxide, silicon carbide, and silicon nitride.

* * * * *